US008651381B2

(12) United States Patent
Rudich

(10) Patent No.: US 8,651,381 B2
(45) Date of Patent: Feb. 18, 2014

(54) FIREARM SIGHT HAVING AN ULTRA HIGH DEFINITION VIDEO CAMERA

(76) Inventor: David Rudich, Los Angeles, CA (US)

( * ) Notice: Subject to any disclaimer, the term of this patent is extended or adjusted under 35 U.S.C. 154(b) by 0 days.

(21) Appl. No.: 13/299,346

(22) Filed: Nov. 17, 2011

(65) Prior Publication Data

US 2012/0126002 A1 May 24, 2012

Related U.S. Application Data

(60) Provisional application No. 61/415,166, filed on Nov. 18, 2010.

(51) Int. Cl.

| | |
|---|---|
| ***G06F 19/00*** | (2011.01) |
| ***G06G 7/80*** | (2006.01) |
| ***F41G 1/00*** | (2006.01) |
| ***F41G 1/38*** | (2006.01) |

(52) U.S. Cl.
USPC ..... 235/404; 235/405; 235/407; 235/411; 89/41.17; 42/122

(58) Field of Classification Search
USPC ..... 235/400–418; 42/122; 89/41.17
See application file for complete search history.

(56) References Cited

U.S. PATENT DOCUMENTS

| | | | | |
|---|---|---|---|---|
| 3,295,128 | A * | 12/1966 | Canaday et al. | 342/129 |
| 5,026,158 | A * | 6/1991 | Golubic | 356/252 |
| 5,675,112 | A | 10/1997 | Giry et al. | |
| 6,070,355 | A | 6/2000 | Day | |
| 6,125,308 | A * | 9/2000 | Hills et al. | 701/1 |
| 6,449,892 | B1 | 9/2002 | Jenkins | |
| 7,292,262 | B2 | 11/2007 | Towery et al. | |
| 7,810,273 | B2 * | 10/2010 | Koch et al. | 42/111 |
| 7,926,219 | B2 | 4/2011 | Reimer | |
| 7,944,611 | B1 * | 5/2011 | Regan et al. | 359/422 |
| 2005/0268512 | A1 | 12/2005 | Salvitti | |
| 2008/0163536 | A1 * | 7/2008 | Koch et al. | 42/111 |
| 2010/0251593 | A1 | 10/2010 | Backlund et al. | |
| 2011/0315767 | A1 * | 12/2011 | Lowrance | 235/404 |

FOREIGN PATENT DOCUMENTS

| | | |
|---|---|---|
| DE | 10105036 | 12/1993 |
| DE | 4218118 | 8/2002 |
| EP | 0966647 | 12/1999 |

* cited by examiner

*Primary Examiner* — Michael G Lee
*Assistant Examiner* — Laura Gudorf
(74) *Attorney, Agent, or Firm* — Novak Druce Connolly Bove + Quigg LLP

(57) ABSTRACT

A sighting apparatus for a firearm includes a video camera capable of capturing and tracking the path of a projectile The captured images are taken generally concurrently with the firing of the first projectile, and with the projectile reaching the target. A video display includes a reticle positioned at the center of the display to permit the user to aim the firearm by positioning the reticle over the target. A processor receives captured images from the camera. An output interface delivers information to the video display to enable the video display to display images of the target area. Software and a processor determine the flight path of the projectile and the point where the projectile impacts or passes by the intended target and adjusts for the variance between the two points by moving the image on the display.

5 Claims, 6 Drawing Sheets

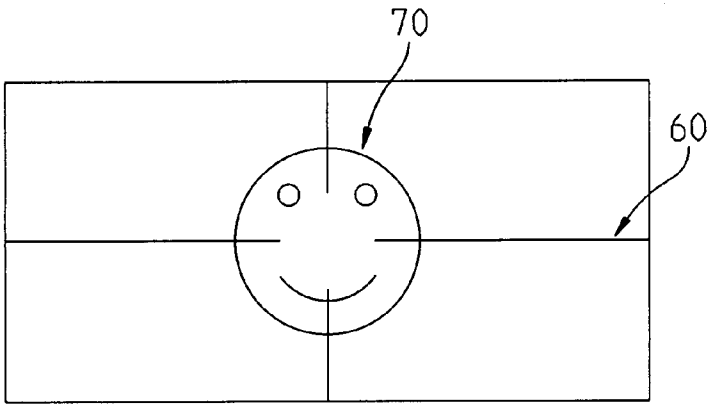
Fig. 7a
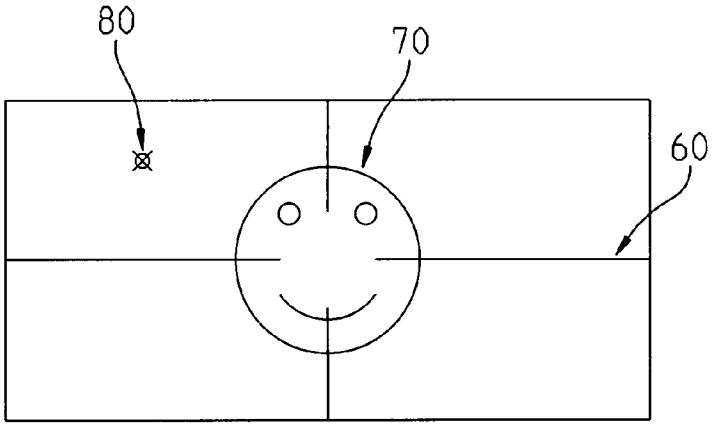
Fig. 7b
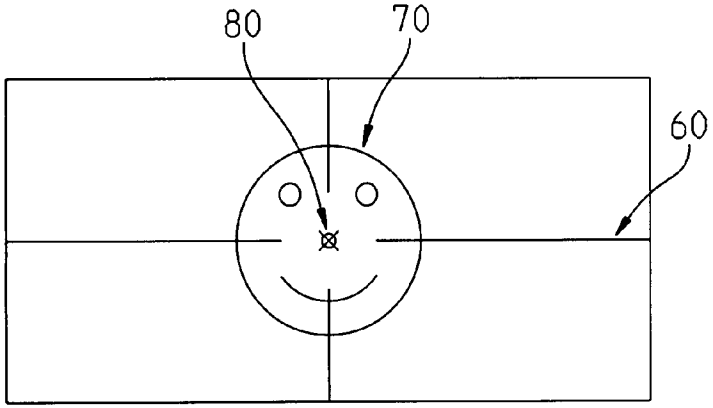
Fig. 7c
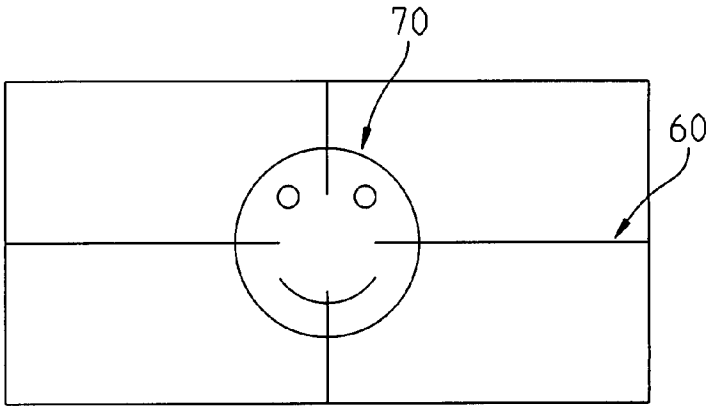
Fig. 7d
Fig. 7

FIREARM SIGHT HAVING AN ULTRA HIGH DEFINITION VIDEO CAMERA

REFERENCE TO RELATED APPLICATIONS

This application claims the benefit of Rudich, U.S. Provisional Application No. 61/415,166, filed 18 Nov. 2010, which application is fully incorporated herein by reference.

I. TECHNICAL FIELD OF THE INVENTION

The present invention relates to fire arms, and more particularly, to a firearm system having a sighting mechanism that enables the user to achieve a better target hit rate by enabling the user to correct for such things as distance, weather conditions, windage and gravity.

II. BACKGROUND OF THE INVENTION

It is often difficult for firearms to achieve a high degree of accuracy in hitting their targets when the firearms solely employ an optical sighting mechanism such as open "iron" sites to a sighting telescope. This difficulty is caused in particular by various influences having an increasing impact on the ability to accurately aim the rifle, as the distances from the rifle to the target increase. One influence on the inaccuracy of a projectile is that a projectile travels along a ballistic trajectory that is determined by the design and fabrication of the firearm.

The type of ammunition used also influences the trajectory of a projectile. Moreover, for the same ammunition, the cartridge temperature and barrel temperature at the time of discharging each projectile, both influence the course of the projectile's trajectory. For the reasons stated above, it is useful to provide a sighting mechanism for a firearm that is capable of making corrections that take into account the existing circumstances that influence the trajectory of the projectile. Preferably, the device's ability to correct are such that they can be altered automatically and performed and made virtually instantaneously.

Several attempts have been made to overcome the problems discussed above.

United States Patent Publication No. 2005/0268521 A1, discloses an electronic sighting mechanism for a firearm that includes a laser range finder, a global positioning system antenna for receiving electromagnetic GPS signals of a known type emitted by a GPS satellite, a wind sensor, a tilt sensor, a pressure sensor for sensing ambient barometric pressure in the vicinity of the device, a sensor for detecting ambient temperature and ambient humidity in the vicinity of the device, an accelerometer, and a gyroscope. Each of the foregoing is operationally coupled to a processing section. The device is arranged on the firearm in parallel with the barrel of the firearm such that the device captures the image of the sighting field and displays it on a video screen with a reticle arranged on the screen. The reticle is positioned automatically according to the incoming data so that the position of the reticle in the sighting field corresponds to the approximate point of projectile impact as calculated by the processing section, which utilizes inputs from the aforementioned sensors and devices.

An apparatus and method for determining, displaying and recording the impact point of one or more projectiles from a firearm on a sighting field is disclosed by U.S. Pat. No. 5,026,158, to Golubic. The Golubic apparatus uses sensor elements to measure and calculate the effects of humidity, temperature, barometric pressure, angle of elevation, wind velocity at the point of the device and direction of each projectile without the need of actual discharge of the firearm by recording calculated impact points on the stored field of view and displays them as impact point reticles, relative to zero-range reticle superimposed upon the sighting field by the device. The device uses a trajectory calculating microprocessor unit, an optical image conversion unit such as a charged coupled device or suitable integrated circuit, a recording unit, a range finder associated with the trajectory calculating microprocessor unit and a plurality of sensors which automatically supply the trajectory calculating microprocessor unit with environmental conditions. An entry device is employed to enter parameter data into the trajectory calculating processor unit in a plurality of control switches. The calculation of the estimated projectile point of impact is made relative to the field of view of the zoom lens and the image presented to the observer by combining signals from the trajectory calculating microprocessor unit with the signal providing an image to be displayed on the display/recording unit. The device is intended to be used for dry-firing the firearm for practice shooting. The invention therefore eliminates the need for using live ammunition during hunting and/or target acquisition activity and can provide a record of the estimated result of discharging a projectile.

U.S. Pat. No. 6,070,355, to Day, discloses a gun mounted video camera provided with a gun. Also included is a video camera connected to the gun for accepting video images of a target. Day discloses a video scope wherein the device can be utilized for viewing and recording a target in real time while hunting.

U.S. Pat. No. 7,926,219 B2, to Reimer, discloses an improvised digital scope for locating and targeting objects. The scope includes an imaged detection device that is configured to collect image data of a sighted region. The scope further includes a display screen that is electronically connected to the image detection device and is configured to display image data of the sight of region as a continuous video feed.

U.S. Pat. No. 7,292,262 B2, to Towery et al. discloses a firearm that can detect engagement of a firing pin with a cartridge and can respond to this event by saving an image that shows the target and reticle at a time just prior to the detected event. The electronic reticle can be downloaded into the sight. The effect of the position of the reticle within the sight can be moved electronically and a zoom factor of the sight can be adjusted electronically. The sight can sense approximate transfer movement, and provide a user with an indication of the amount of transfer of movement that occurs when the firearm to which the device is affixed is fired. With the use of an additional device, the sight can automatically align its reticle to the bore of a firearm on which the sight is mounted. The device measures and indicates transfers movement that the marksman causes to occur when the marksman fires a firearm.

US Patent Pub No. US 2010/0251593 A1, to Backlund et al., discloses a device for automatic calibration of optical sights for a firearm wherein only one shot is fired to sight in the firearm. The device can be integrated with an optical sight or fitted as a separate unit mounted on the sight. The device consists of a digital camera, a beam splitter, a microprocessor including a memory for camera images and computer software, servo motors, a gear mechanism, an electrical switch and light emitting diodes in a shot detecting sensor. In a digital sight application, the device also includes a display unit while servo motors, gear mechanisms, light emitting dials and beam splitter are excluded.

The calibration procedure involves firing a round at a target consisting of a rectangular white surface on a dark background at a chosen target range. The camera saves the last image immediately before the firing moment and compares the crosshairs position with that of a follow up image from which the projectile point of impact can be found on the rectangular white surface on the dark background. After calculations that determine the error between the point of aim and the projectile point of impact which are based on image analysis only, the position of the cross-hairs is adjusted by servo motors to align with the detected projectile impact point position in the digital sight application.

A sighting telescope for a firearm is shown in EP 0966 647 B1, wherein a sighting telescope is equipped with at least one micromotor and a laser beam telemeter that determines the distance between the marksman and the target disc. This distance is transmitted to a computer that stores the perpendicular of the trajectory of the bullet at said distance in its memory. The computer triggers the micromotor as a function of the distance thus determined and of the perpendicular of the trajectory of the bullet at this distance. It is further provided that the sighting telescope is attached to a horizontal rotational axis such that it can be swiveled and that the micromotor is placed such that it can swivel the sighting telescope about the horizontal rotational axis in order to vary the angle of the sighting telescope with respect to the axis of the firearm on which the sighting telescope is to be used in order to correct the elevation or depression of a shot with respect to a zero point as a function of the distance thus determined and of the perpendicular to the trajectory of the bullet in order to thus vary the position of the reticle of the sighting telescope from the original target point to the target point provided for said distance. Moreover, it allows a second micrometer to be placed such that it allows the sighting telescope to be swiveled about a vertical axis in order to correct the angle of the trajectory towards the right and towards the left with regard to a zero point, and do so as a function of the wind velocity and/or motion of the target disc.

A digital sighting telescope mounted on a small firearm is known from DE 101 05 036 A1. This invention provides that a screen replaces or supplements the eyepiece of the sighting telescope. Moreover, various forms of reticle can be selected or faded-in in this digital sighting telescope, whereby each selected and faded-in reticle is centered in the middle of the image and upon readjustment remains in the original middle of the image and, upon a change of program, the new reticle is centered to the position of the previous reticle and therefore the holding point remains unchanged, whereby an image with shot-tested stored reticle can be accepted to obtain a program. In the case of multi-barreled firearms, this is carried out for each barrel. Moreover, the DE '036 reference provides that the digital sighting telescope can be mounted on multiple firearms. Each firearm is shot-tested with each reticle and thus data is obtained and stored.

DE 42 18 118 C2 discloses a sighting telescope equipped with adjusting organs that is attached to a rifle, in particular a hunting rifle. In addition, a distance meter is used. The invention also provides that a processor connected to a distance meter via a measuring transducer is attached to the sighting telescope. This processor comprises a replaceable chip card on its input side, in which ballistic parameters of the bullet used are recorded, and which, on its output side, is connected to an adjustment motor of the adjusting organ for effecting a vertical change of the sighting optics and to an adjustment motor of the adjusting organ for effecting a lateral change of the sighting optics.

From U.S. Pat. No. 6,449,892 B1 discloses a firearm, such as a rifle. This rifle is equipped with a computer that provides additional information and communication options to the marksman to support the marksman during a mission. However, the '892 sighting mechanism comprises a single sighting optics that is directed to be parallel to the barrel of the firearm and that is combined with a camera. Combination with a night-viewing device is also possible, if needed. The recorded image is displayed on a screen within the sighting field of the marksman. Processing of the image is not carried out in this context. It appears that data from the global positioning systems (GPS), from a laser distance meter and from an azimuth and aiming height sensor is entered into the computer and used by the computer to calculate the coordinates of a selected target relative to the position of the sighting mechanism and firearm. These target coordinates are then displayed by the computer of the firearm on a display such as to be visible to the marksman. By this means, the marksman receives readable information that supports him in the process of aiming. However, the marksman must analyze and assess the data displayed to him himself and draw his own conclusions from the data displayed, and he must change the direction of the firearm accordingly.

U.S. Pat. No. 5,675,112 A discloses a firearm with a corresponding sighting mechanism that utilizes two cameras. A first camera is arranged on the barrel of the firearm and its lens is directed at a marksman operating the firearm. A second camera is situated on a piece of equipment worn by the marksman, in particular a helmet, and directed at the target area. In this context, the cameras are directed such that each camera is within the area of recording of the corresponding other camera. A corresponding computer calculates a trajectory of the firearm from the data delivered by the two cameras and displays it optically on a screen that is situated within the sighting field of the marksman and displays only the image of the target area recorded by the second camera.

From U.S. Pat. No. 7,810,273 B2 discloses a sighting mechanism for a firearm, including two video cameras, a video screen, a digital sighting distance meter, a sensor for measuring environment, cartridge and/or firearm parameters, a biometric sensor, a memory module for biometric data and/or munitions data and a digital computer. The video cameras are arranged parallel to each other to capture the target sighting field. The computer has video inputs and an image processing unit enabling the video image data to be superimposed in a pixel precise manner in relation to the target field on the screen. The computer includes a ballistic computer which enables the target image to reproduce the screen. A reticle arranged on the screen can be positioned automatically and in real time according to the incoming data, such that the position of the graticule in the target field corresponds to a calculated approximate point of projectile impact.

Although the above-mentioned devices likely perform their intended duties in a workmanlike manner, room for improvement exists.

It is therefore one object of the present invention to provide a sighting mechanism that provides for accurate aiming by the marksman, while being simple to operate and quick to actuate.

III. SUMMARY OF THE INVENTION

A sighting apparatus for a firearm is capable of firing at least a first and second projectile out of a firearm barrel, and sighting apparatus includes a video camera having a sufficient frame speed rate and resolution to be capable of tracking the path of each projectile when shot from the firearm and capturing a series of images. The series of images include at least a first image taken of a target containing field that is captured at a time before and generally concurrently with the firing of the first projectile, and additional images taken of a target containing field that is captured before and generally concurrently with the projectile reaching the distance of the target. A video display screen is provided for the user to employ to sight the target and aim the firearm. The video display includes a display of an image of the target containing field and a recticle positioned to permit the user to aim the firearm by positioning the reticle over the target. A processor includes an input interface in communication with the camera for enabling the processor to receive captured images from the camera, an output interface in communication with the video display for enabling the processor to deliver information to the video display to enable the video display to display images of the target area, a memory for storing captured images, and a computer program for operation of the processor to process image information captured by the camera. The software and processor process the first image and the additional images to determine a spatial difference between the position of the intended target point centered under the reticle in the first image, and a position of the projectile relative to the intended target point in the second image, and correcting for deviations from linear in the path of the projectile between the firearm and the target by moving the relative position of the image of the target field so that it is centered under the reticle displayed on the video display to improve the accuracy of the next shot.

One feature of the present invention is that a high speed, ultra high definition digital video camera ("UHD camera") can be mounted on a firearm parallel to its barrel that records a target sighting field and each projectile in flight. Alternately, the firearm sight can be monitored wirelessly or via a wired peripheral operatively linked to a UHD Camera.

A preferred embodiment can include a digital computer or processor having as an input an interface for the ultra high definition video camera and having an output interface for the video screen whereby the digital computer unit determines the moment that the recoil of the firearm from a discharge of a shot abruptly alters the incoming image field, while determining the point of impact of the projectile or the point where the projectile passes the intended point of impact. These determined point(s) are compared to the point of the center of the reticle on the image field immediately before the disruption caused by the recoil calculated by the computer unit as a function of the data that is incoming by means of the input interface in preparation for the next shot.

Another feature of the present invention is that a digital computer or processor is incorporated into the UHD camera for recording and digitally controlling the video input, and/or the digital computer or processor is operatively connected to the firearm sight image gathering apparatus. The image input from the firearm sight can be controlled so that a fixed reticle in the firearm sight is superimposed over the target field. The target field image is moved with respect to the fixed reticle in order to align the actual point of impact of a projectile or the point where the projectile passed by the intended point of impact with the central position of the reticle.

Where the UHD camera does not detect an actual point of impact or the point where the projectile passes the intended point of impact, the processor determines the track path of the last projectile fired and provides a solution where the projectile impact would have been, or the point where the projectile passed by the intended point of impact and shifts the position of the image field in the sighting device accordingly. If and to the extent that the UHD camera cannot track the projectile from the muzzle of the firearm all of the way to the final destination of the projectile, the computer extrapolates from the trajectory, the angle, and the speed of the projectile to the extent that the UHD camera can track the projectile, as well as any discernable impact that the projectile may make on the target field to determine its precise point of impact or the point where the projectile passes the intended point of impact.

Applicant believes that superior weapon firing accuracy is achieved by moving the image of the target field automatically to align the actual point of impact of the last projectile fired or the point where the projectile passed by the intended point of impact with the center of the reticle, the reticle being fixed in the sighting device. Projectile firing causes a recoil signature that can be distinguished from other types of target field image movement in a video camera. Recoil can be accommodated for in adjusting the movement of the target field by programming the device to select an image with the reticle displayed the instant before recoil occurs so that the actual point of impact, the projected point of impact or the point where the projectile passed by the intended point of impact is used in order to move the image of the target field to place the point directly at the center of the reticle to perfectly sight in the sighting device and the firearm to enhance the accuracy of the next shot.

Preferably, the computer in the sighting device is programmed so that if and to the extent that the UHD camera cannot track the projectile from the muzzle of the firearm all of the way to the final destination of the projectile, the computer extrapolates from the trajectory, the angle, and the speed of the projectile as well as any discernable impact that the projectile may make on the target field to determine its precise point of impact or the point where the projectile passes the intended point of impact. A digital computer or processor preferably has an interface for the ultra high definition video camera to input data to the processor. The processor has an output interface for the video screen.

The processor is programmed so that the digital computer unit determines the moment that the recoil of the firearm from a discharge of a shot abruptly alters the incoming image field while determining the point of impact of the projectile or the point where the projectile passes the intended point of impact and compares it to the point of the center of the reticle on the image field immediately before the disruption caused by the recoil calculated the computer unit as a function of the data that is incoming by means of the input interface in preparation for the next shot. The digital computer unit is programmed to correct the variance between the point of impact (or the point where the projectile passes the intended point of impact) and the intended point of impact.

This variance is corrected by centering the image of the point of impact or the point where the projectile passes the intended point of impact on the video screen directly under the center of the fixed reticle in preparation for the next shot thereby perfectly sighting in the sighting device and the firearm.

In the event that there is no point of impact on the target field, an integrated distance measuring instrument such as a laser range finder, a measuring transducer or a distance determining algorithm utilizing the known size of an object in the target field is utilized to calculate the point where the projectile passes the intended point of impact. If and to the extent that the UHD camera cannot track the projectile from the muzzle of the firearm all of the way to the final destination of the projectile, the computer extrapolates from the trajectory, the angle, and the speed of the projectile to the extent that the UHD camera can track the projectile as well as any discernable impact that the projectile may make on the target field to determine its precise point of impact or the point where the projectile passes the intended point of impact.

A further feature of the present invention is that a digital computer or processor having as an input an interface for the ultra high definition video camera and having an output interface for the video screen is provided. The digital computer unit determines the moment that the recoil of the firearm from a discharge of a shot abruptly alters the incoming image field while determining the point of impact of the projectile or the point where the projectile passes the intended point of impact. This is compared to the point of the center of the reticle on the image field immediately before the disruption caused by the recoil calculated by the computer unit as a function of the data that is incoming by means of the input interface. In preparation for the next shot, the video screen displays a corrected position of the target image under a superimposed reticle calculated by the computer unit as a function of the data that is incoming by the means of the input interface in preparation for the next shot.

IV. BRIEF DESCRIPTION OF DRAWINGS

FIG. 1 is a highly schematic diagrammatic view of a sighting mechanism mounted on a firearm according to the invention;

FIG. 2*a* is a side view of a typical rifle and a typical prior art rifle mounted "scope" sighting system;

FIG. 2*b* is a side schematic view of a typical rifle with a sighting device of the present invention mounted to the weapon;

FIG. 3*a* is a perspective view of a typical military style weapon with an embodiment of the present invention mounted thereon;

FIG. 3*b* is a perspective view of a typical military style weapon having another embodiment of the present invention mounted thereon;

Figure 6:
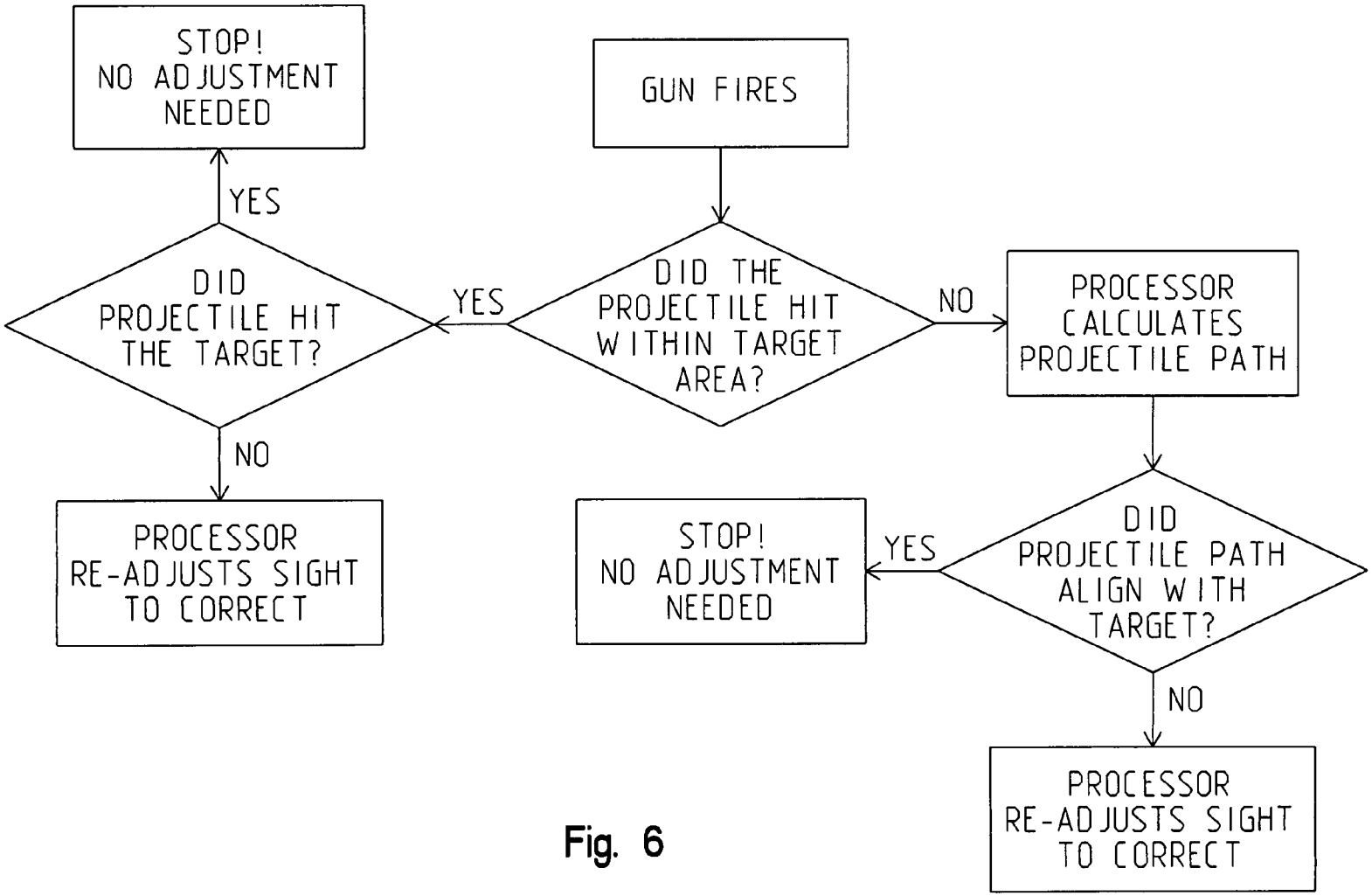

FIG. 6 comprises a flow chart depicting the logic sequence used by the processor to determine whether an adjustment should be made to the sight; and FIGS. 7*a-d* are sequential drawings depicting the sighting device of the system and targets, as the device moves through its adjustment process.

V. DETAILED DESCRIPTION

A. An Overview of the Present Invention.

A sighting mechanism of the present invention is characterized in that a high speed, ultra high definition digital video camera is arranged on the firearm in such a manner that it has a lens capture area disposed parallel to the barrel of the firearm so that the camera can and does capture the target field, the area surrounding the target field, and the flight path of a fired projectile on a video screen. An integrated digital computer unit is in communication with the camera. The computer has a video input interface for receiving digital image data from the video camera. In essence, the integrated digital computer unit comprises a digital image processing computer that allows a selectable image portion of the image data received from the video camera to be superimposed in a pixel precise fashion and in real-time to form a target image and an image of the projectile in flight and to be displayed on the screen The digital computer can be used to position the target image displayed on the screen and a reticle that is situated on and at the center of the screen in an automatic manner and in real time based upon the data that is being received from the camera through the input interface such that the position of the point of impact on the target image or the point where the projectile passes the intended point of impact is directly under the reticle at the center of the video screen. In the event that there is no point of impact on the target field, an integrated distance measuring instrument such as a laser range finder, a measuring transducer or a distance determining algorithm utilizing the known size of an object in the target field is utilized to calculate the point where the projectile passes the intended point of impact.

If and to the extent that the UHD camera cannot track the projectile from the muzzle of the firearm all of the way to the final destination of the projectile, the computer extrapolates from the trajectory, the angle and the speed of the projectile (to the extent that the UHD camera can track the projectile) as well as any discernable impact that the projectile may make on the target field to determine its precise point of impact or the point where the projectile passes the intended point of impact. By so determining where the projectile hits, or passes, one can then determine the variation between the point at which the gun is aimed and the point at which the projectile hits, to thereby determine the variance in the projectile caused by such things as humidity, barometric pressure, gravity, distance, and wind.

The sighting mechanism of the invention is believed to allow for very precise target striking accuracy since the ultra high definition digital video camera and the pixel precise digital image superimposition in real time provide for very high image quality at high resolution and low thermal and digital noise levels and low pixel noise levels and thus yield a very high quality real image of the target. Preferably, the camera provides not only an ultra high definition resolution, but also provides shots at a very high speed (e.g. 300 frames per second or greater.

The present invention provides the potential to correct for substantially all material parameters influencing the trajectory of the projectile automatically and quickly. Preferably, the integrated digital computer unit displays the image field immediately prior to the sudden movement of the image field caused by recoil of the firearm from a discharged shot. The integrated digital computer unit then instantaneously determines the point of impact of the projectile that is tired or the point where the projectile passes the intended point of impact from the data that is inputted from the high speed, ultra high definition video camera. The position of the target image is then adjusted so that the point of impact on the image screen or the point where the projectile passes the intended point of impact is directly under the reticle that is centered on the video screen.

In the event that there is no point of impact on the target field, an integrated distance measuring instrument such as a laser range finder, a measuring transducer or a distance determining algorithm utilizing the known size of an object in the target field is utilized to calculate the point where the projectile passes the intended point of impact. If and to the extent that the UHD camera cannot track the projectile from the muzzle of the firearm all of the way to the final destination of the projectile, the computer extrapolates the likely trajectory, the angle, and the speed of the projectile from the trajectory, angle, and speed information of the projectile from that portion of the projectiles flight that the UHD is able to track. Additionally any information relating to any discernable impact that the projectile may make on the target field can be added to the extrapolated values to determine a very close approximation of the precise point of impact or the point where the projectile passes the intended point of impact.

Though this process, the firearm should be sited in perfectly for the next shot, and perfectly corrected for all variables that affect the trajectory of the projectile. The video screen in the sighting field of the marksman then shows both the real time target as a real time image and the reticle in a clear display. The marksman advantageously has no need to interpret, assess, or analyze data displayed to him, but rather can focus solely on aiming the firearm, since the correction of the position of the reticle relative to the target image is carried out automatically.

Through the use of the present invention, the target and the reticle are optically visualized significantly better and simpler than the view one receives through a sighting telescope which cannot provide automatic digital correction of the position of the reticle relative to the image of the target and which cannot correct for any influences on the trajectory of the projectile. The digital computer unit integrated into the sighting mechanism processes the incoming data and uses it to calculate the position of the reticle relative to the image of the target on the video screen such that the real point of impact of the projectile on the target or the point where the projectile passes by the intended point of impact coincides with the position of the center of the reticle on the image of the target on the screen.

The marksman operating the firearm can therefore rely on the image on the screen and does not need to correct the direction of the firearm based on his on experience or his own perception of environmental parameters such as wind, humidity, distance and the like. Accordingly, many of the inherent variables that impact a shot are accounted for to thereby increase the hitting accuracy for any firearm upon which the sighting device is mounted, as the primary variable remaining to be accounted for is the steadiness of the hands of the marksman operating the firearm, or the support upon which the firearm is placed.

Since no environmental sensing devices are required with the present invention, no firearm or ammunition related data needs to be inputted, no mechanical adjustment or adjustment by motor(s) of parts of the sighting mechanism are required and no mechanical effort is required. Thus, cost savings are achieved along with a reduction provided by the reduction or elimination or the sensitivity of the device to wear and tear and damage. The sighting mechanism can advantageously be used without any adjustment or prior input or data pertaining to any firearms any ammunition or firearms system upon which the sighting mechanism is mounted.

B. Detailed Description of the Drawings.

Figure 1:
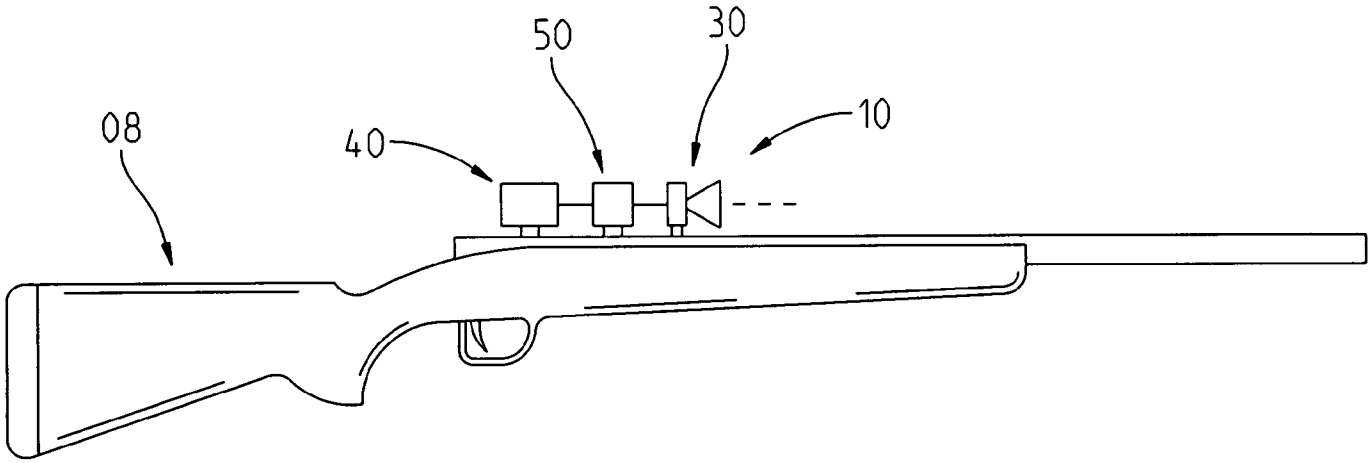
Figure 4:
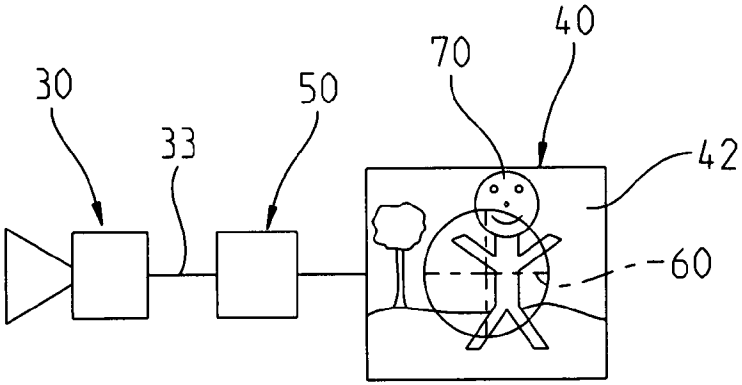
FIG. 4 is another highly schematic view of the sighting mechanism of the present invention.

A sighting mechanism 10 is shown schematically in FIGS. 1 and 4 as being mounted to a firearm such as rifle 20. The mechanism 10 includes an ultra high definition digital video camera 30 with a digital processor 50 integrated into the camera 30 or the mounting base of the camera and wirelessly connected to the video output and the viewing screen 40 of the camera. The sighting mechanism 10 is attached to a firearm 20 above the barrel that is partially schematically shown in FIG. 1.

The sighting mechanism includes a mounting system that enables it to be mounted on the firearm. Preferably the adaptor is a universal type mounting adaptor so that the sighting mechanism 10 can be used on various types of firearms and weapon systems and is movable from a firearm or weapon system of a first type to a firearm or weapon system of a second type without having to make changes to the sighting mechanism and without having to input any data to the sighting mechanism whatsoever.

The high speed, ultra high definition digital video camera 30 is arranged so that the lens is positioned for being parallel to the barrel 22 so that the images captured by the UHD camera 30 are generally along the path that a projectile fired out of the barrel will take.

The video camera 30 is connected to the integrated computer unit 50 by means or a suitable input interface 33. Accordingly, the camera 30 delivers images of an aimed-for target 70, FIG. 4, whereby at least a portion of the image is digitally imposed in the computer unit 50 in a pixel precise fashion and in real time. Accordingly, a good and clear image of the target 70, FIG. 4 is attained even if the target distance is large.

Moreover, the sighting mechanism comprises a viewing screen 40 that displays a portion of the image of the target field 42 that is recorded by the high speed, ultra high definition video camera 30 and is inputted into the computer unit 50 and displayed on the display screen 40 such that a marksman or weapons user has a good view of the target 70. A reticle 60 is faded into the target field 42 or otherwise placed on the center of the display screen 40.

Figure 3B:
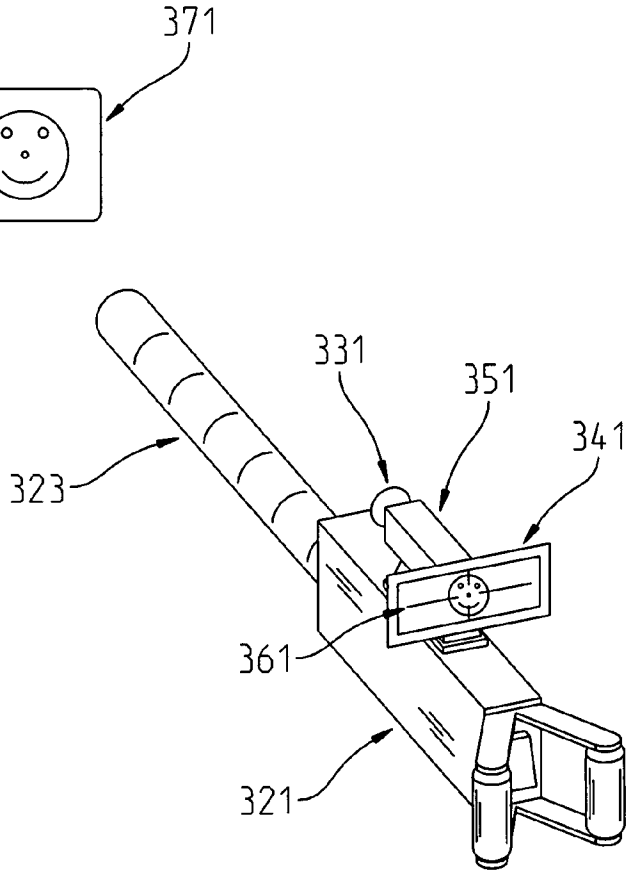
Figure 3A:
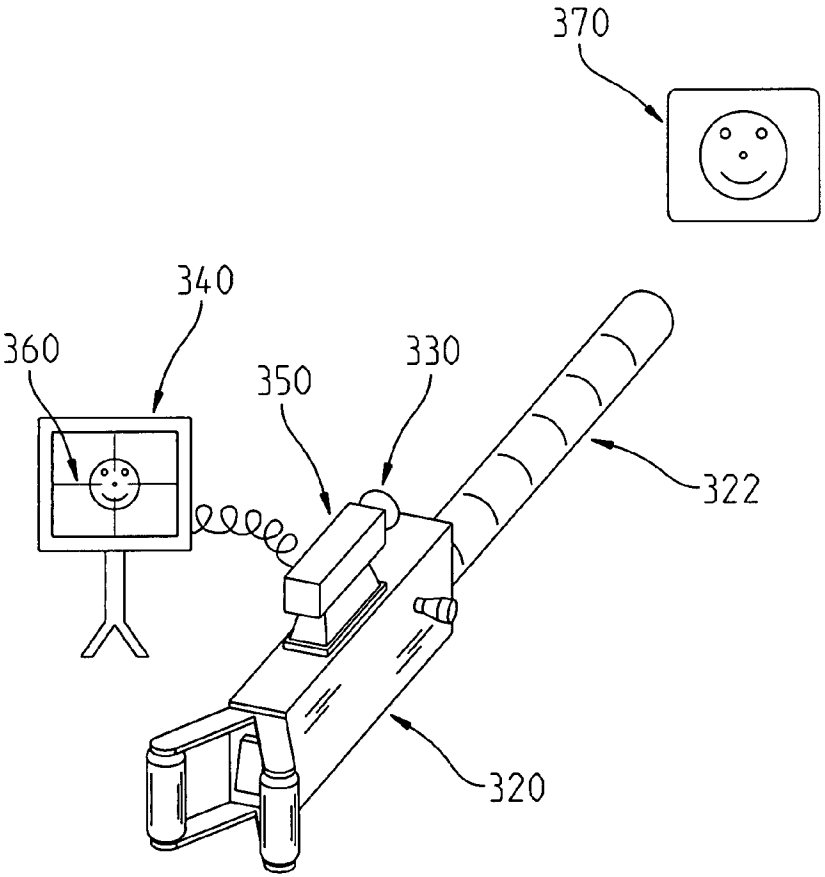

Turning now to FIGS. 3*a* and 3*h*, the operator of the weapon 320, 321 aims the weapon 320, 321 by positioning the weapon in such a way that the reticle 360, 361 displayed in the display screen 340, 341 is centered on the target 370, 371 that the operator of the weapon 320, 321 wishes to hit. In the FIG. 3*a* embodiment, the display screen 340 is mounted adjacent to the weapon so that movement of the gun 320 will be isolated from the display screen 340. In FIG. 3*b*, the display screen 341 is fixedly coupled to the weapon 321.

Once the operator has aimed the weapon 320, 321 and acquired his target 370, 371, the operator is ready to fire the weapon 320, 321. Once the operator tires the weapon 320, 321, the processor 350, 351 detects that a shot has been fired. The processor 350, 351 records the video image taken by the camera 330, 331 just prior to the shot being fired. In order to do this, the camera 330, 331 is constantly capturing images. The processor 350, 351 is constantly recording some cache of video and maintaining it in memory. The processor 350, 351 does not need to retain a large amount of data recorded prior to the shot, but rather, only enough so that it will have video of the target and reticle position immediately prior to the shot being fired. Other images captured prior to the firing of the shot may be discarded or dumped from memory.

Figure 5:
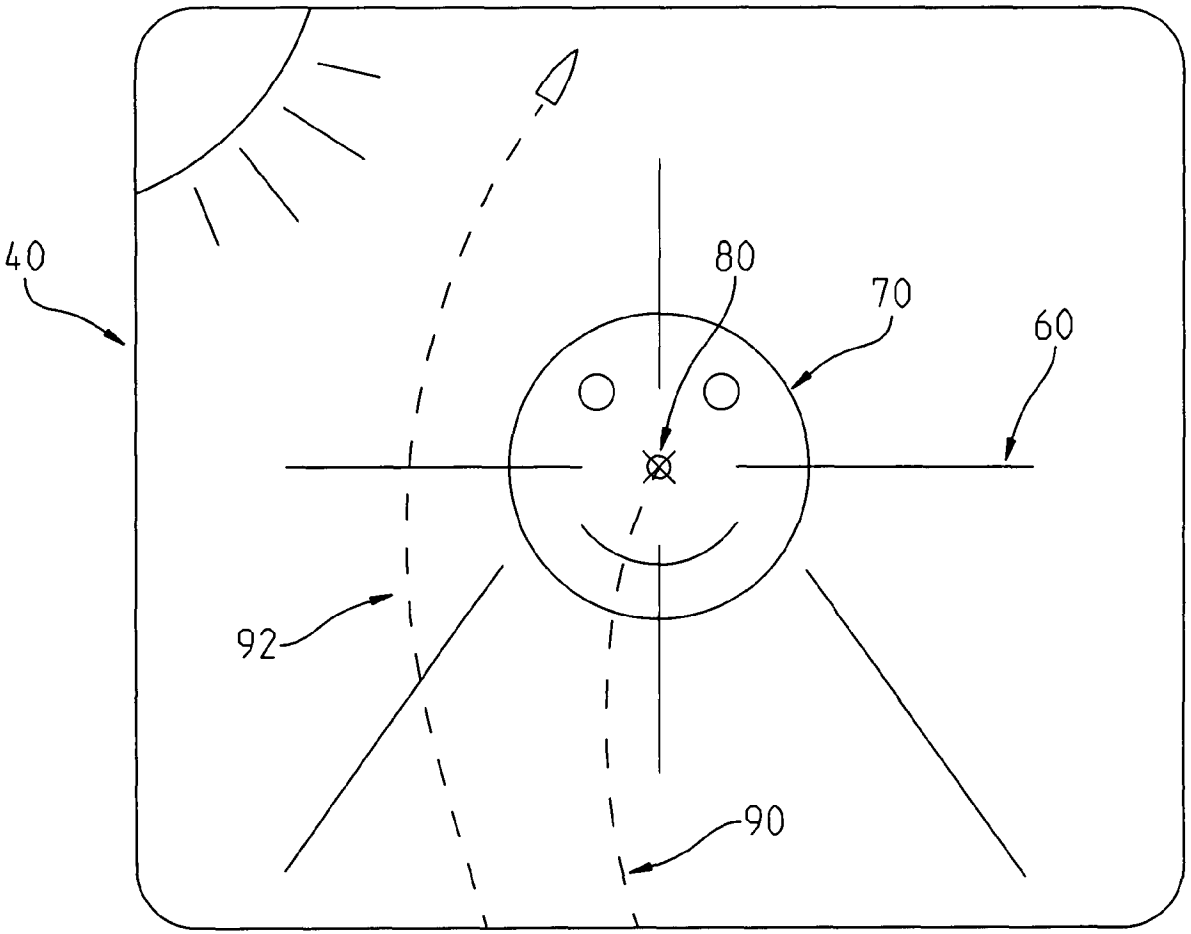
FIG. 5 is a schematic view illustrating the targeting features and aspects of the present invention.

Turning now to FIG. 5, once the processor 350, 351 has detected that a shot has been fired, the processor 350, 351 starts recording to ensure that it has saved captured images taken by the camera 330 immediately prior to the shot being fired, thereby ensuring that an appropriate member of such "just before the shot" images are not lost by being dumped. The processor 50 continues to record and save captured images of the flight of the projectile and, if applicable, images that capture the impact of the bullet in the target field 42. Once the processor 350, 351 has recorded the flight of the projectile and or the impact of the projectile in the target field, the processor 50 can then calculate whether the projectile struck an object in the field 70, or traveled to the destination that was intended by comparing the recorded video images to the position of the reticle on the target taken immediately prior to the shot.

FIG. 5 shows that the operator aligned the reticle 60 on the target 70 and fired the weapon. The images captured immediately prior to the shot show that the reticle was centered on the target 70. After the shot, the projectile traveled in the path 92 as indicated by the actual projectile path 92. By comparing the intended projectile path 90 to the actual projectile path 92, the processor 50 can calculate the deviation between the actual projectile path 92 and the intended projectile path 90 and through processing by software driven processor 50, can use this information to correct the centering of the reticle 60 accordingly.

This correction of the reticle would, in a preferred embodiment adjust the position of the image displayed on the display screen 40, relative to the reticle. For example, if the user was sighting on the target's head, but the actual path of the projectile 92 deviated such that the projectile struck the target thirty inches (76.2 cm) below the target's head by striking the target 70 in the navel, the position of the reticle 60 relative to the target would be adjusted to account for this thirty inch (76.2 cm) deviation at the target position. When so adjusted, when the user next sighted in on the head of the target, the changed relative position of the reticle 60 and image 42 would cause the user to actually be aiming thirty inches (76.2 cm) above the head of the target, even though the user has the cross-hairs of the reticle 60 squarely on the target's head. This deviation between actual and corrected images on the display in the projectile's projected thirty inch drop, to thereby cause the projectile to hit the target squarely in the head, which was the target upon which the user sighted.

Turning now to FIGS. 7*a*-7*d*, FIG. 7*a* represents a picture of the sighted target 70 immediately prior to a shot from the weapon 20 being fired. FIG. 7*h* represents a picture of the sighted target after the shot was fired and after the projectile impacted the target field 42. In FIG. 7*b* it will be noticed that the point of impact 80 does not line up with the center of the reticle 60 as desired. The processor 50 compares the point of impact 80 with the position of the center of the reticle 60 and re-adjusts the position of the target field image with relation to the reticle 60 on the display screen. FIG. 7*c* depicts the recorded image of a shot fired after the processor 50 has adjusted the reticle 60 position for the next shot. As shown, the processor 50 uses either the path or the point of impact as a reference point to re-adjust the field of view in relation to the reticle for the next shot.

FIG. 6 shows a flow chart of a logic process that the processor 50 can use to determine if an adjustment to the reticle 60 position is needed, as desirable. As illustrated in the diagram, an adjustment to the relative position of the image and reticle is only made if the point of impact of the previously fired projectile, or the path of the previously fired projectile differs from the intended point of impact or the intended flight path. If the path or point of impact is different than intended, then the processor will make the necessary adjustments to correct the position of the target field in relation to the reticle.

Turning now to FIGS. 1, 1*a*, 3*a* and 3*b*, various placements of the various components of the device will now be discussed.

Figure 2A:
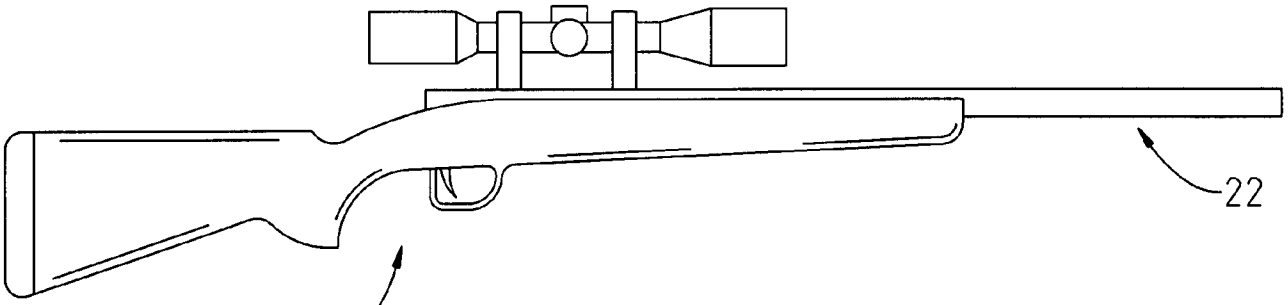
Fig. 2a Prior Art
Figure 2B:
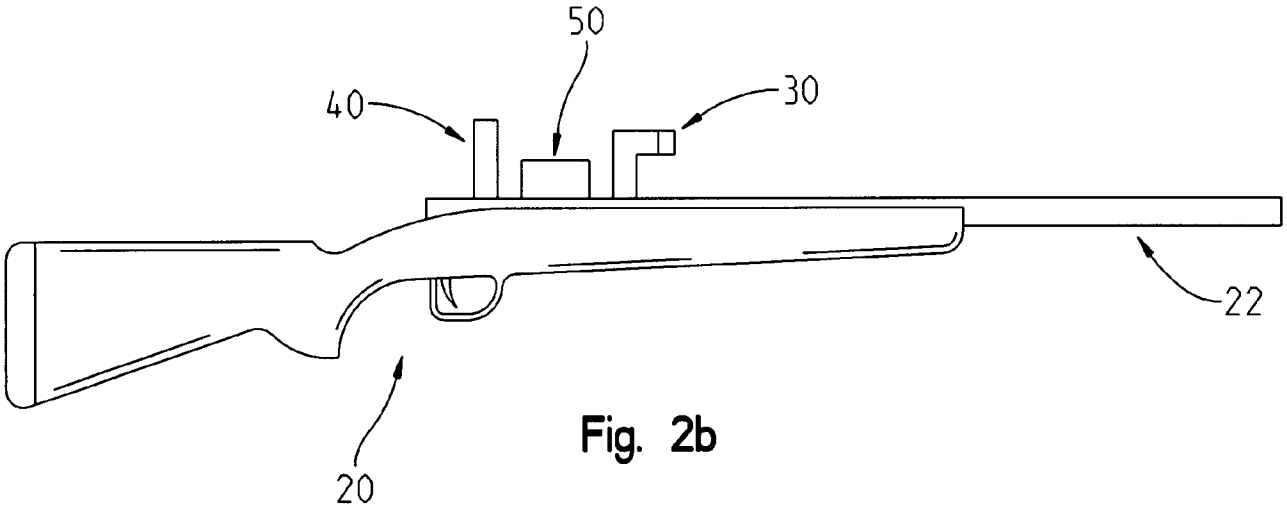

As best shown in FIGS. 1, 2*b* and 3*b* all of the primary components of the device 10, including the UHD camera 30, processor 50 and display screen 40 are all mounted onto an upper surface of the firearm 08. This is a similar configuration to the placement of the camera 331, processor 351 and video display 341 of FIG. 3*h*. This placement has many advantages, as through the use of compact dedicated electronics, the sighting mechanism "package" can be made small enough so as to not interfere significantly with the operation of the weapon and can be very portable, since the entire device 10 is carried around with the weapon. Additionally, having all of the components in one place creates a neat and tidy package for the user.

Alternately, one or more of the components can be separated from the gun. As shown in FIG. 3*a*, the camera 330 and processor 350 are mounted to the gun 320. However, the video display screen 340 is mounted separately from the gun, and is operatively coupled to the gun 320, through either hard wire configuration or preferably, a wireless communication link, such as BlueTooth.

One of the benefits of separating the video display 340 from the gun is that it permits a larger video display screen 340 to be used, than one whose size is constrained by the need to place it on top of the gun 320. More importantly, the placement of the video screen 340 on a separate mounting away from the gun 320 isolates the video display screen 340 from gun movement, which may have benefits in reducing the processing difficulties encountered in processing the image information taken by the camera, to derive the repositioned image.

The computer unit 50 compares the relative positions of the reticle 60 over the image of the target 70 immediately prior to the computer or an integrated accelerometer making the determination that the recoil from a shot has caused the field of view of the target image to be abruptly shaken or altered. The computer 50 compares a position of the reticle 60 over the target 70 image immediately prior to the shot being fired with the point that the computer 50 unit determines from the video input from the ultra high definition video camera 30 is the actual point of impact 80 of the projectile that is tired or the point where the projectile passes the intended point of impact. The computer unit 50 then rectifies the discrepancy between the two positions by shifting position of the image of the target field so that the point of impact or the point where the projectile passes the intended point of impact is directly under the center of the reticle 60. The sighting mechanism 10 and firearm 20 are thereby perfectly sighted in for the next shot to be fired at the target field (42).

FIGS. 7*a*-7*d* are exemplary monitor output images from a weapon sight made in accordance with an embodiment of the present invention. FIG. 7*a* shows the target field image 42 and reticle 60 position immediately prior to a shot being tired. In FIG. 7*b*, an uncorrected target field image shown immediately after the shot, in which the center of the reticle 70 is shown with respect to an impact point 80 where the projectile passes by the intended target 70 (i.e., the X shows the impact position or the point where the projectile passed by the intended target in the two dimensional image of a projectile monitored by the gun sight).

FIG. 7*c* is the corrected image from FIG. 7*b*. To make the correction, the system of the present invention 10 moves the image field 42 placement on the display screen so that the point of impact or the point 80, (FIG. 7*b*) where the projectile passed by the intended target 70 of the last projectile fired is aligned with the center of the reticle 66. Once so positioned, a user firing his second shot (FIG. 7*c*) can aim the gun at the center of the target 70. The position of the image has been shifted to account for the deviation in the projectile path caused by factors such as humidity, distance, wind, barometric pressure, etc. Therefore, aiming the gun at the center of the "viewed, shifted" target will cause the fired projectile to strike the spot 80 at which the user was aiming. In an alternate embodiment, a cursor can show how far the impact position of the prior projectile has been shifted in the image field.

Turning now to FIG. 6, a flowchart is shown that helps to illustrate the operation of the device is shown. Flowchart box 600 comprises the first step in the process, wherein the gun fires its projectile. Box 600 contemplates the shot fired as the first shot that the user takes at the target 70.

Turing now to Box 610, the first decision point occurs when a determination is made as to whether the projectile hit within the target area 42. This is determined through the interaction of the camera that is taking pictures of the target area so that the device 10 can get a fix on the spot 80 impacted by the projectile. These images are forwarded to the processor 50 for processing the information. The results of these captured images and processed images can be displayed on the video display 40 wherein the user can make a visual determination of whether the projectile hit the object 70 within the target area 42 that the user can see.

the projectile did hit something within the target area 42, the next decision box 620 seeks to determine whether the projectile hit the actual target 70.

A determination of whether the projectile hit the target 70, begs the decision of whether an additional shot is necessary. If the projectile hit the target 70, as shown in box 630, there is no need to continue to the procedure by taking a second shot, since the target 70 has been hit. Since the target has been hit, and there is no need for a second shot, there is no necessary need to adjust the relative positions of the reticle 60 and the target 70. Even if the user decides to take a second shot, the fact that the projectile hit the target, suggests that no further adjustment is necessary between the position of the reticle 60 and the target 70.

On the other hand, if the projectile did not hit the target as shown at box 632, the processor goes through its calculations, to determine the difference in position between the point at which the rifle was aimed, and the point at which the projectile hit (whatever it hit) to make an adjustment in the relative position of the reticle 60 and target 70. The adjustment is made so that on the second shot, the user can sight the weapon directly on the target and hit the target since the deviation in the projectile projection path will be taken into account and adjusted for when resetting and adjusting the relative positions or the reticle 60 and target 70.

Turning back to the decision box 610, if the projectile did not hit within the target area, the processor 50 and camera 30 will then have no impact point at which to capture images of and record and process in the processor 50.

As there is no image of the place where the projectile hit, the processor is then employed to calculate the projectile path. As described above, the projectile path is calculated by mathematically processing the image of the projectile that is shown in the images captured by the camera 30, during the time after the projectile is fired or until such time as either the projectile hits its impact point, or some other predetermined time has passed.

The above is shown at decision box 634. The next decision box 636 asks the question of whether the projectile path is aligned with the target. If the projectile path is aligned with the target 70, it is highly likely that the projectile hit the target, but that the impact mark made by the projectile is not visible or recognizable by the camera 30 and processor 50. However, if the projectile path does align with the target 70, one moves then to decision box 638 that states that you stop the process, as there is no need for adjustment.

Since the target 70 was likely hit by the projectile, there likely is no need to adjust for a second shot. However, even if a second shot is desired, the fact that the projectile likely hit the target 70 suggests that the current alignment will serve well to enable the user to hit the target with a second shot, since there exists relatively little or no deviation between the target sighted in the reticle and the point impacted by the projectile.

It will be appreciated that this scenario could also describe the second projectile fired by the weapon. For example, if the user fired the rifle the first time, and the projectile hit the target area 70 but the projectile did not hit the target 70, the processor would be required to readjust the sight correct, as shown at decision box 632. Assuming this adjustment was made, the gun on firing the second time, could have launched the projectile along a path that enabled the projectile to hit the target, although the projectile impact spot was not seen. This would then suggest that the adjustment made at decision box 632 was a correct adjustment, and that any further shot (if so desired) could be made as the target was properly "sighted in".

On the other hand, if the projectile path did not align with the target, one then arrives at the decision point of decision box 640. At such a point, the processor 50 readjusts the relative position of the reticle 60 and the image, so that the user, on a subsequent shot can sight the target such that it is in the middle of the reticle, thereby hitting the target with the deviations in projectile path already being accounted for through the processor and alignment.

In an alternate embodiment, a cursor can be shown in the image field to indicate the prior shot, a series shots or a tracer pattern. Software and systems for tracking a target in a video monitor are used extensively in weapons systems. These include Cursor On Target or "CoT" technologies, mapping technologies, global positioning systems. etc. and can be used to monitor multiple targets, multiple weapons and projectile tracking histories. Various software and hardware systems have been developed, some of great sophistication and expense, e.g., U.S. Pat. No. 5,686,690. Although good at what they do, such systems still require significant training for use, are quite bulky and/or heavy, etc. While it is possible to have a gun mount that would automatically adjust azimuth and elevation to fix on a target, this is impractical for maximum individual mobility.

While such prior art systems are impractical, aspects of the technology incorporated into the prior art, target sighting and tracking can be applied by one of skill in the art without undue experimentation in creating a weapon sight and weapon system in accordance with the present invention. For example technologies for moving an image with respect to a point in an image field are known in other, non-related, non-analogous applications such as an Internet mapping program. In such programs, moving a cursor over a map causes the image to be re-centered with respect to the cursor.

In the alternative, an image can be viewed from a fixed point while the image is moved with respect to the fixed point. Image processing and Graphical User Interface (GUI) technology is included in a wise variety of commercially available computing systems and video cameras, even low cost models, which include editing capabilities that allow for the superimposition of markings.

Use of the present invention with different weapons can be accomplished by placing a weapon in a fixed mount, establishing a firing monitor on the weapon to detect when the weapon is fired and the displacement associated with firing under different conditions and using different ammunition. While an image data gathering device can be fixed to the weapon or placed in a known position with respect to the weapon, processing of the data therefrom can be done remotely.

Data can be transmitted to a processor wirelessly, and more than one image data gathering device may be used, so that the track of a projectile can be better monitored. For example, an ultra high definition, high speed camera can be used to collect image data, and this data used in accordance with the embodiments described above. A second such camera could be used to help provide depth of field and to help calculate distance to target. Further, the present invention can be used with technologies that enhance human vision, such as infrared imaging, thermal imaging, filtering, etc.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

What is claimed is:

1. A sighting apparatus for a firearm capable of firing at least a first and second projectile out of a firearm barrel, the sighting apparatus comprising (a) a video camera having a sufficient frame speed rate and resolution to be capable of tracking a path of the first projectile when shot from the firearm and capturing a series of images, the series of images including (i) at least one first image taken of a target containing field that is captured at a time before and generally concurrently with the firing of the first projectile, (ii) at least one second image of the path of the first projectile from the firearm barrel to the target field, and (iii) at least one third image taken of a target containing field that is captured before and generally concurrently with the projectile reaching the distance of the target, (b) a video display screen for the user to employ to sight the target and aim the firearm, the video display including a display of an image of the target containing field and a fixed reticle positioned to permit the user to aim the firearm by positioning the reticle over the target, (c) a processor including (i) an input interface in communication with the camera for enabling the processor to receive the captured images from the camera, (ii) an output interface in communication with the video display for enabling the processor to deliver information to the video display to enable the video display to display images of the target area, (iii) a memory for storing the captured images, and (iv) a computer program for operation of the processor to process image information captured by the camera, wherein the computer program and processor process the at least first, second and third images to determine a spatial difference between a position of the target relative to the reticle in the first image, and a position of the projectile relative to the reticle in the third image, and correcting for deviations from linear in the path of the projectile between the firearm and the target field by automatically shifting the target field to position the point of impact of the projectile, or the point where the projectile passes the intended point of impact, at the center of the fixed reticle on the video display to account for the deviations caused by environmental factors, gravity and firearm parameters without the use of sensors for the environmental factors to improve likelihood of the second projectile striking the target when the center of the reticle is positioned on the target; and (d) said sighting apparatus is arranged to be used on various types of weapons and weapon systems and is movable from a weapon or weapon system of a first type to a weapon or weapon system of a second type without having to make changes to the sighting apparatus and without having to input any data to the sighting apparatus whatsoever.

2. The sighting apparatus of claim 1 wherein the video camera continuously captures images in a time span beginning prior to the firing of the first projectile and ending after the first projectile has had sufficient time to travel to the target, further comprising a sensor for sensing movement of the firearm resulting from the firearm firing a projectile.

3. The sighting apparatus of claim 2 wherein the sensor is in communication with the processor for delivering firearm firing information relating to firearm movement resulting from firing the first projectile, for causing the processor to select and store at least one image captured immediately prior to the receipt of the firearm firing information for use as the initial image or images.

4. The sighting apparatus of claim 1, wherein the computer program employs the recognized impact point made by the first projectile as the position of the projectile in the third image for automatically adjusting the position of the target field to place the impact point at the center of the reticle of the target displayed on the video display, and wherein the computer program employs the recognized impact point and position of the target in the first image to determine the spatial distance and directional relationship between the position of the target relative to the reticle in the first image, and the position of the projectile relative to the reticle in the third image, for adjusting the position of the target field to place the impact point at the center of the reticle of the target displayed on the video display to improve the likelihood of the second projectile striking the target, and wherein the computer program employs the image recognition function for recognizing a lack of an impact point made by the first projectile, and wherein the software further includes a projectile trajectory determination feature for determining the trajectory of the first projectile on at least a portion of said first projectile's path during an interval between the firing of the projectile and the capture of the second image.

5. The sighting apparatus of claim 1 wherein the computer program includes a projectile trajectory determination function for determining the trajectory of the first projectile on at least a portion of said first projectile's path during an interval between the firing of the projectile and the capture of the second image, the series of images captured by the video camera include a sufficient number of images captured in a time interval between the capturing of the first image and the capturing of an image at a point generally concurrently with the projectile reaching the distance of the target to permit the projectile trajectory determination function to determine the trajectory of the first projectile, the projectile trajectory determination function determines the spatial distance and directional relationship between the position of the target relative to the reticle in the first image, and the trajectory of the first projectile for adjusting the position of the target field to place the point where the projectile reached the distance of the target at the center of the reticle of the target displayed on the video display to improve the likelihood of the second projectile striking the target, and the projectile trajectory determination function includes an extrapolation function to extrapolate the path of the first projectile between a point wherein the camera loses sight of the first projectile and a point generally concurrently with the projectile reaching the distance of the target for permitting the sighting apparatus to estimate the position of the projectile at a point generally concurrently with the projectile reaching the distance of the target.

* * * * *